US006607359B2

(12) United States Patent
von Flotow

(10) Patent No.: US 6,607,359 B2
(45) Date of Patent: Aug. 19, 2003

(54) APPARATUS FOR PASSIVE DAMPING OF FLEXURAL BLADE VIBRATION IN TURBO-MACHINERY

(75) Inventor: Andreas H. von Flotow, Hood River, OR (US)

(73) Assignee: Hood Technology Corporation, Hood River, OR (US)

( * ) Notice: Subject to any disclaimer, the term of this patent is extended or adjusted under 35 U.S.C. 154(b) by 0 days.

(21) Appl. No.: 10/061,747

(22) Filed: Jan. 31, 2002

(65) Prior Publication Data

US 2002/0164253 A1 Nov. 7, 2002

Related U.S. Application Data

(60) Provisional application No. 60/273,123, filed on Mar. 2, 2001.

(51) Int. Cl.[7] ..... F01D 5/16

(52) U.S. Cl. ..... 416/229 R; 416/231 B; 416/236 R; 416/500

(58) Field of Search ..... 416/229 R, 231 B, 416/235, 236 R, 500

(56) References Cited

U.S. PATENT DOCUMENTS

| | | | | |
|---|---|---|---|---|
| 3,796,513 A | * | 3/1974 | Jonas | 416/224 |
| 3,958,905 A | | 5/1976 | Wood | |
| 3,986,792 A | | 10/1976 | Warner | |
| 4,101,245 A | | 7/1978 | Hess et al. | |
| 4,268,223 A | | 5/1981 | Anner et al. | |
| 4,347,040 A | | 8/1982 | Jones et al. | |
| 4,455,122 A | | 6/1984 | Schwarzmann et al. | |
| 4,460,314 A | | 7/1984 | Fuller | |
| 4,568,247 A | | 2/1986 | Jones et al. | |
| RE32,339 E | | 1/1987 | Jones et al. | |
| 4,936,749 A | | 6/1990 | Arrao et al. | |
| 5,052,890 A | | 10/1991 | Roberts | |
| 5,205,713 A | | 4/1993 | Szpunar et al. | |
| 5,215,442 A | | 6/1993 | Steckle et al. | |
| 5,226,784 A | | 7/1993 | Mueller et al. | |
| 5,281,097 A | | 1/1994 | Wilson et al. | |
| 5,302,085 A | | 4/1994 | Dietz et al. | |
| 5,369,882 A | | 12/1994 | Dietz et al. | |
| 5,373,922 A | | 12/1994 | Marra | |
| 5,478,207 A | | 12/1995 | Stec | |
| 5,490,759 A | | 2/1996 | Hoffman | |
| 5,498,137 A | | 3/1996 | El-Aini et al. | |
| 5,511,948 A | | 4/1996 | Suzuki et al. | |
| 5,558,497 A | | 9/1996 | Kraft et al. | |
| 5,573,375 A | | 11/1996 | Barcza | |
| 5,645,402 A | | 7/1997 | Cornelius et al. | |
| 5,709,527 A | | 1/1998 | Ernst et al. | |
| 5,730,584 A | | 3/1998 | Dodd | |
| 5,785,499 A | | 7/1998 | Houston et al. | |
| 5,820,343 A | | 10/1998 | Kraft et al. | |
| 5,827,047 A | | 10/1998 | Gonsor et al. | |
| 5,924,545 A | | 7/1999 | Crorey | |
| 5,984,638 A | | 11/1999 | Gresh et al. | |
| 6,039,542 A | * | 3/2000 | Schilling et al. | 416/233 |
| 6,155,789 A | * | 12/2000 | Mannava et al. | 416/241 R |

* cited by examiner

*Primary Examiner*—Ninh H. Nguyen
(74) *Attorney, Agent, or Firm*—Bell, Boyd & Lloyd LLC

(57) ABSTRACT

A rotor blade for a turbine engine rotor assembly is provided comprising a root, an airfoil, a platform, and a means for damping vibrations in the airfoil. The airfoil includes a pocket formed into a chordwise surface. The damper is received into the pocket, forming a surface flush with the airfoil. Relative movement between the damper and the airfoil cause vibrational movement to be damped and dissipated in the form of frictional energy.

3 Claims, 3 Drawing Sheets

APPARATUS FOR PASSIVE DAMPING OF FLEXURAL BLADE VIBRATION IN TURBO-MACHINERY

The present application is directly related to U.S. Provisional Patent Application 60/273,123, filed Mar. 2, 2001, the entire contents of which are hereby incorporated by reference and relied upon.

BACKGROUND OF THE INVENTION

1. Field of the Invention

The present invention is for an apparatus for passively damping flexural blade vibration in turbo-machinery. The apparatus comprises at least one mechanical insert, embedded into the blade near its tip. Detailed strength design ensures survival of the insert under the high centripetal loads experienced at the blade tip. Blade flexural energy is dissipated by friction forces and rubbing between the insert and the blade. Surface contact forces are provided primarily by the centripetal force.

2. Description of the Related Art

Compressor sections within an axial flow turbine engine are based upon a series of rotor assemblies. Each rotor assembly comprises a rotating disk and a plurality of blades circumferentially disposed around the disk. The blades are either separate pieces, assembled to the disk, or the entire bladed disk is machined from a single piece of metal.

In operation, compressor blades are loaded centripetally and aerodynamically. The aerodynamic loading is nominally slowly time-varying, varying only with engine operating condition (rotor speed and stage mass flow and pressure rise). But blade vibration is often also excited by rapidly varying aerodynamic loading. Two principal mechanisms for this excitation are: 1/Self-excited flutter, and 2/Aerodynamically forced vibration, where the forcing source is flow inhomogeneities. If these flow inhomogeneities are circumferentially periodic, then the forced vibration may be resonant and some narrow ranges of rotor operating speed will resonantly excite such vibrations.

Blade vibration may occur in any of many natural modes of vibration of the blades. Lower-order modes are generally predictable and relatively easy to avoid exciting or to damp. Higher order modes are generally more difficult to predict and more difficult to damp. These plate-like modes are commonly excited at resonance by flow inhomogeneities created by airfoils in adjacent stages in the engine. These modes typically involve plate-like deformation patterns, with largest motions and largest flexural strains near the tip of the blade.

Left unchecked, blade vibration can cause premature blade failure and can liberate a portion of the blade, causing substantial damage to the engine. In either vibration case, (flutter or resonant forced vibration,) passive damping helps reduce the amplitude of the vibratory material stresses and thus extends the life of the blade.

| Specific References | |
|---|---|
| U.S. Pat. No. 3,958,905 | (Wood) |
| U.S. Pat. No. 3,986,792 | (Warner) |
| U.S. Pat. No. 4,101,245 | (Hess et al.) |
| U.S. Pat. No. 4,268,223 | (Anner et al.) |
| U.S. Pat. No. 4,347,040 | (Jones et al.) |
| U.S. Pat. No. 4,455,122 | (Schwarzmann et al.) |

-continued

| Specific References | |
|---|---|
| U.S. Pat. No. 4,460,314 | (Fuller) |
| U.S. Pat. No. 4,568,247 | (Jones et al.) |
| U.S. Pat. Re. 32,339 | (Jones et al.) |
| U.S. Pat. No. 4,936,749 | (Arrao et al.) |
| U.S. Pat. No. 5,052,890 | (Roberts) |
| U.S. Pat. No. 5,205,713 | (Szpunar et al.) |
| U.S. Pat. No. 5,215,442 | (Steckle et al.) |
| U.S. Pat. No. 5,226,784 | (Mueller et al.) |
| U.S. Pat. No. 5,281,097 | (Wilson et al.) |
| U.S. Pat. No. 5,302,085 | (Dietz et al.) |
| U.S. Pat. No. 5,369,882 | (Dietz et al.) |
| U.S. Pat. No. 5,373,922 | (Marra) |
| U.S. Pat. No. 5,478,207 | (Stec) |
| U.S. Pat. No. 5,490,759 | (Hoffman) |
| U.S. Pat. No. 5,498,137 | (El-Aini et al.) |
| U.S. Pat. No. 5,511,948 | (Suzuki et al.) |
| U.S. Pat. No. 5,558,497 | (Kraft et al.) |
| U.S. Pat. No. 5,573,375 | (Barcza) |
| U.S. Pat. No. 5,645,402 | (Cornelius et al.) |
| U.S. Pat. No. 5,709,527 | (Ernst et al.) |
| U.S. Pat. No. 5,730,584 | (Dodd) |
| U.S. Pat. No. 5,785,499 | (Houston et al.) |
| U.S. Pat. No. 5,820,343 | (Kraft et al.) |
| U.S. Pat. No. 5,827,047 | (Gonsor et al.) |
| U.S. Pat. No. 5,924,545 | (Crorey) |
| U.S. Pat. No. 5,984,638 | (Gresh et al.) |

The above-listed patents address damping of blade vibration in turbomachinery. With the exception of U.S. Pat. No. 5,498,137 (El-Aini et al.), all of these patents address low-order modes. Most of these patents describe a damping system which acts upon blade-to-blade motion at the root of the blades, motion which is not present in high-order modes.

Only the El-Aini et al. patent is closely related to the present invention. El-Aini et al. describe a pocket machined into a solid-section metal fan or compressor blade, a lid fastened over that packet and contoured to match the outer shape of the blade, and any of several different damping inserts placed into that pocket.

Like El-Aini et al., the present invention also addresses higher-order plate-like vibration modes of solid-section metal blades. Like El-Aini et al, the present invention also proposes a pocket machined into a surface of the blade, near the blade tip. But unlike El-Aini et al., the present invention does not propose a lid and a damping insert. Instead, the pocket is machined with under-cut edges, and a metal sheet is slipped into this pocket such that the undercut edges of the pocket engage the metal sheet and prevent it from escaping. The metal sheet itself forms the contoured aerodynamic surface of the blade.

Damping is achieved by rubbing between the flexing blade and the metal sheet. Friction in this way dissipates flexural energy. Contact force between the metal sheet insert and the host blade material is provided both by elastic deformation of the inserted metal sheet and by centripetal force which serves to push the metal sheet against the edge and against the bottom of the pocket machined into the blade.

SUMMARY OF THE INVENTION

It is an object of the present invention to provide a rotor blade for a turbine engine rotor assembly that includes a means for damping higher order modes of vibration.

It is another object of the present invention to provide means for damping vibration in a rotor blade which minimizes disturbance to air flow adjacent the rotor blade.

It is still another object of the present invention to provide means for damping vibration in a rotor blade which does not negatively affect the structural integrity of the rotor blade.

It is still another object of the present invention to provide means for damping vibration in a rotor blade which can be installed easily and in a cost efficient manner.

It is still another object of the present invention to provide means for damping vibration in a rotor blade that can be tailored and positioned in the blade to counteract specific vibratory conditions.

More specifically, the present application discloses a rotor blade for a turbine engine rotor assembly. The rotor blade comprises an airfoil, having a curvature and a pocket formed in a chordwise surface, the pocket open to the surface; and means for damping vibrations in the blade, the means including a damper where the damper is received within the pocket and the damper is contoured to match the curvature of the airfoil.

In a preferred embodiment of the rotor blade, one or more edges of the pocket are undercut as a means of locating and restricting motion of the damper in the pocket.

In another preferred embodiment, the damper is contoured to be received by the pocket with sufficient contact surface area.

In another preferred embodiment, the damper is retained in the pocket using only frictional forces acting on the contact surface area.

In a more preferred embodiment, centripetal forces acting on the damper tend to retain the damper within the pocket.

The present application also discloses a method for damping vibrations in a rotor blade. The method comprises the steps of determining vibratory characteristics of the rotor blade, including determining where strain energy regions exist for selected modes of vibration within the airfoil; determining a geometry for one or more pockets in a chordwise surface of the airfoil, such that the pockets are located in high strain energy regions of the rotor blade; forming the pocket in the chordwise surface; and inserting a damper in the pocket.

These and other objects, features and advantages of the present invention will become apparent in light of the detail description of the best mode embodiment thereof, as illustrated in the accompanying drawings.

DETAILED DESCRIPTION OF THE INVENTION

According to the present invention, a rotor blade for a turbine engine rotor assembly is provided comprising a root, an airfoil, a platform, and a means for damping vibrations in the airfoil. The airfoil includes a pocket formed into a chordwise surface. The damper is received into the pocket, forming a surface flush with the airfoil. Relative movement between the damper and the airfoil cause vibrational movement to be damped and dissipated in the form of frictional energy.

Figure 1A:
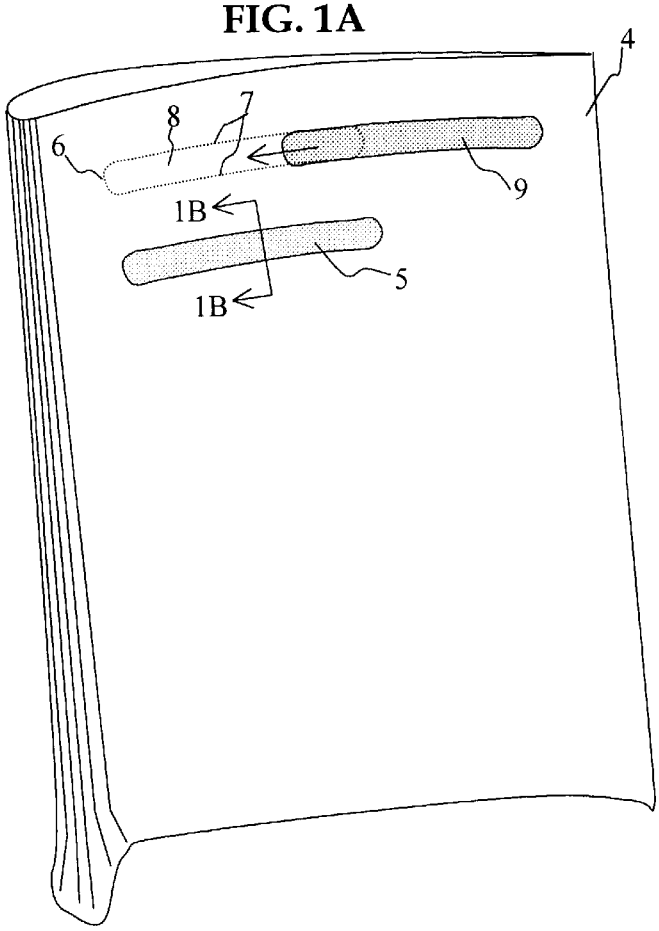
FIG. 1A illustrates the basic concept of a thin metal sheet inserted into a shallow machined pocket in a solid metal blade. Undercut edges on the machined pocket retain the inserted sheet.

Referring to FIG. 1A, an airfoil 4 of a rotor blade for a turbine engine is shown. The rotor blade includes a root, an airfoil, a platform positioned in the transition area between the root and the airfoil 4, and a means 5 for damping vibrations in the blade. Each airfoil 4 includes a pocket 6 for receiving the means 5 for damping vibrations. The pocket 6 is disposed in a chordwise face of the airfoil 4 and is defined as having sidewalls 7 and an inner surface 8. The means 5 for damping includes a metal strip 9 inserted into the pocket 6.

Figure 1B:
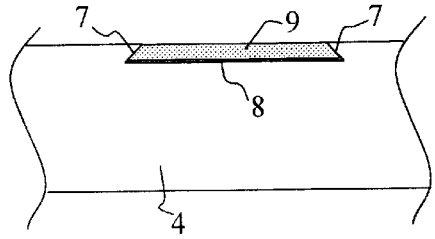
FIG. 1B is a sectional view along the line 1B—1B in FIG. 1A.

Referring to FIG. 1B, the sidewalls 7 of the pocket 6 are undercut so that the damper 9 is held firmly in place. The damper 9 is a metallic element contoured to create an ample amount of contact surface with the pocket 6. Additionally, the damper 9, when received by the pocket 6, forms a surface flush with airfoil 4.

Figure 2:
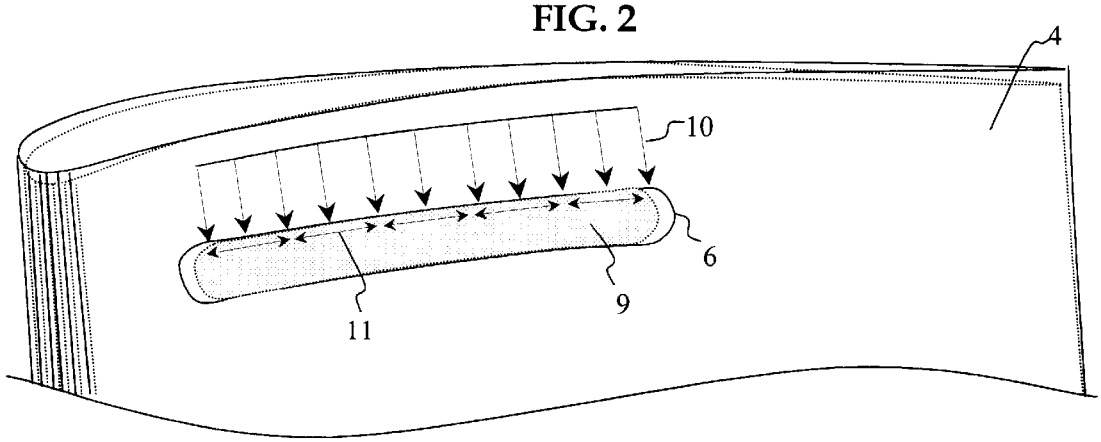
FIG. 2 illustrates the anticipated damping mechanism; rubbing between the metal insert and the flexing blade.

Referring to FIG. 2, when vibrations are induced on the rotor blade, the airfoil 4 deforms. The vibrations cause strain deformation on the surface of the airfoil 4. The centripetal effect of the spinning rotor blade assembly causes very high contact forces 10 between the damper 9 and the pocket 6. The coefficient of friction between these two surfaces causes the damper 9 to restrain the deforming airfoil 4. When the airfoil 4 deformation is large enough, slipping 11 occurs between the damper 9 and the pocket 6, dissipating energy as heat.

Figure 3:
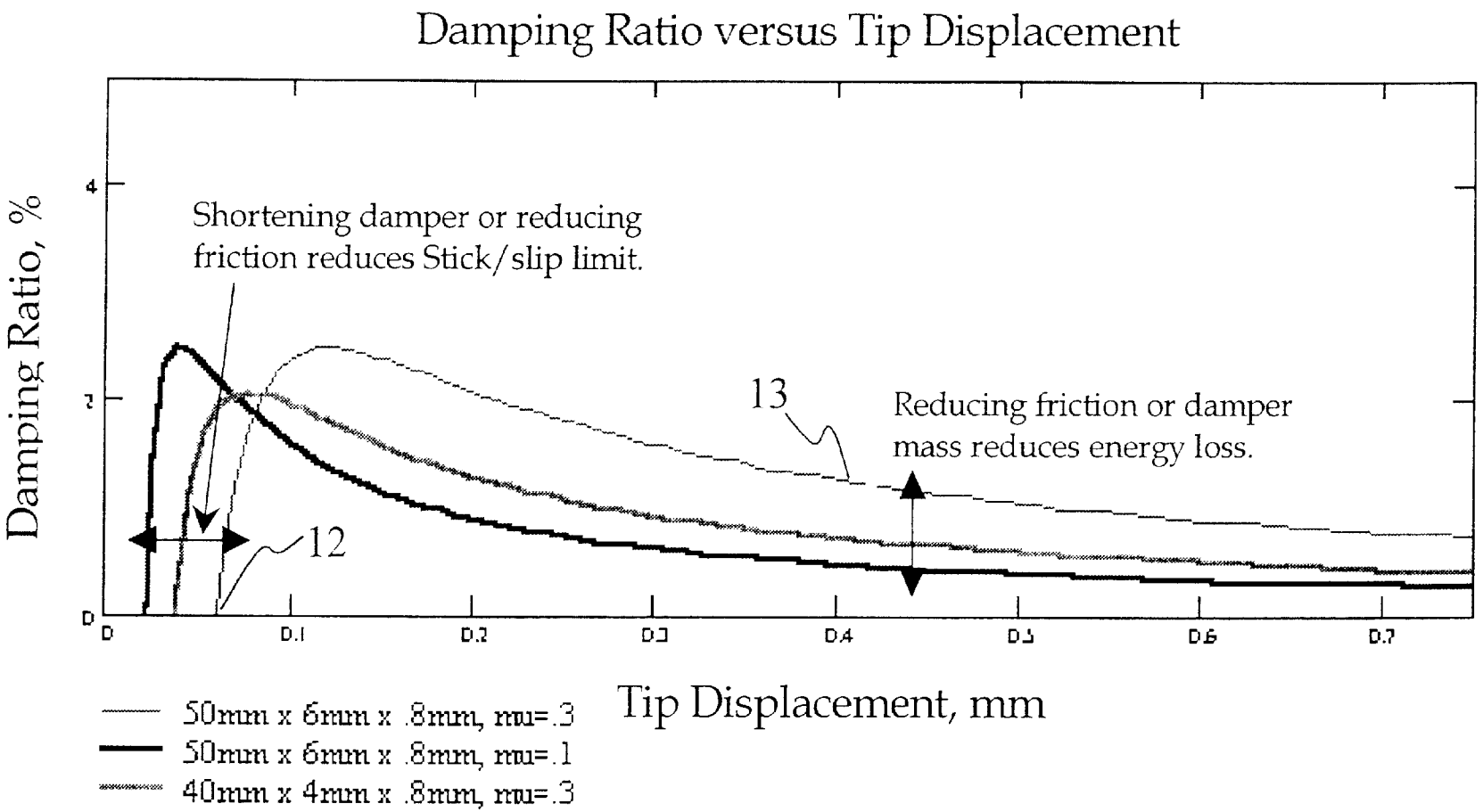
FIG. 3 provides a theoretical prediction of achieved damping ratio as a function of vibration amplitude. The damping mechanism underlying this analysis is dry friction, with a coefficient of friction of 0.3

Referring to FIG. 3, an example analysis is shown relating damping ratio to tip displacement. The important features of this graph are the stick/slip limit 12 which can be affected by shortening the damper 9 or reducing the coefficient of friction between the damper 9 and the pocket 6. The other important feature is that the energy loss 13 is reduced by reducing the coefficient of friction between the damper 9 and the pocket 6 or reducing the mass of the damper.

One advantage of the present invention is that means for damping vibrations in a rotor blade is provided which minimizes air flow disturbance adjacent the rotor blade. Minimizing turbulent air flow within a rotor assembly is critical both performance-wise and to prevent undesirable forcing functions downstream and the vibrations that often accompany them. The damper in the present invention is inserted to form a surface which is flush with the airfoil, thus minimizing the air disturbance adjacent the rotor blade.

Another advantage of the present invention is that the means for damping vibrations has minimal effect on the structural integrity of the rotor blade. The present invention is most effective in locations on the rotor blade with high vibrational strain energy. Strain energy is highest at the air foil surface. The depth of the pocket of the present invention needs to be only a small fraction of the rotor blade thickness. Thus the structural integrity of the rotor blade is not compromised.

Still another advantage of the present invention is that the means for damping vibration in a rotor blade can be installed easily and in a cost efficient manner. Pockets may be cast or machined into rotor blades without significant difficulty. The damper requires no fasteners, which may become dislodged and cause significant damage to the engine, nor welding, which may degrade rotor blade structural integrity.

Still another advantage of the present invention is that the means for damping vibration in a rotor blade can be tailored and positioned in the blade to counteract specific vibratory conditions in particular blades. The present invention permits the blade to be tested and subsequently have a damping means location selected. Specific higher order vibratory conditions can be identified and then accommodated using the present invention by being located at locations of high strain energy.

Although this invention has been shown and described with respect to the detailed embodiments thereof, it will be understood by those skilled in the art that various changes in form and detail thereof may be made without departing from the spirit and scope of the claimed invention.

What is claimed is:

1. A rotor blade for a turbine engine rotor assembly, comprising:

a) an airfoil, having a curvature and a pocket formed in a chordwise surface, said pocket open to said surface; and b) means for damping vibrations in said blade, said means including a damper, wherein said damper is received within said pocket and said damper is contoured to match the curvature of said airfoil, wherein one or more edges of said pocket are undercut as a means of locating and restricting motion of said damper in said pocket, wherein said damper is contoured to be received by said pocket with sufficient contact surface area, and wherein said damper is retained in said pocket using frictional forces acting on said contact surface area.

2. A rotor blade according to claim 1, wherein centripetal forces acting on said damper tend to retain said damper within said pocket.

3. A method for damping vibrations in a rotor blade, comprising steps of:

a) determining vibratory characteristics of said rotor blade, including determining where strain energy regions exist for selected modes of vibration within said airfoil;

b) determining a geometry for one or more pockets in a chordwise surface of said airfoil, such that said pockets are located in high strain energy regions of said rotor blade;

c) forming said pocket in said chordwise surface; and d) inserting a damper in said pocket.

* * * * *